United States Patent [19]

Douglas

[11] 3,936,231

[45] Feb. 3, 1976

[54] OIL WELL PUMPOFF CONTROL SYSTEM

[75] Inventor: Bobby L. Douglas, Garland, Tex.

[73] Assignee: Dresser Industries, Inc., Dallas, Tex.

[22] Filed: Nov. 5, 1974

[21] Appl. No.: 520,993

Related U.S. Application Data

[63] Continuation-in-part of Ser. No. 469,264, May 13, 1974, Pat. No. 3,930,752, which is a continuation-in-part of Ser. No. 365,881, June 1, 1973, Pat. No. 3,854,846.

[52] U.S. Cl. ..... 417/12; 417/43

[51] Int. Cl.² ..... F04B 49/00

[58] Field of Search ..... 417/12, 33, 36, 38, 40, 417/43, 44, 26; 73/290 V

[56] References Cited

UNITED STATES PATENTS

| | | | |
|---|---|---|---|
| 2,336,083 | 12/1943 | Franz | 417/33 |
| 3,054,022 | 9/1962 | Baker | 417/44 |
| 3,079,596 | 2/1963 | Atkinson | 73/290 V |
| 3,091,179 | 5/1963 | Echols | 417/12 |
| 3,453,962 | 7/1969 | Strader | 417/38 |
| 3,778,694 | 12/1973 | Hubby et al. | 318/474 |

*Primary Examiner*—William L. Freeh
*Assistant Examiner*—G. P. La Pointe
*Attorney, Agent, or Firm*—Michael J. Caddell; William E. Johnson, Jr.

[57] ABSTRACT

A sensor associated with the production of an oil well generates a signal indicative of pumpable fluid available in the wellbore. The signal activates a first oscillator whose count is compared with a variable frequency oscillator having a frequency of approximately one-half that of the first oscillator. The comparison is made over a given period of time to ascertain the percentage of time the well has produced fluid. The integrated timer is adjusted to shut down the system when the percentage of time the valve is open drops to the preselected amount. In response to the integration timer producing a signal, a shutdown timer is turned on which restarts the cycle after a preselected amount of time. The length of shutdown time for the pumping unit is preset according to the well fill-in rate. When the system is restarted by the shutdown timer, a pump-up timer is turned on which is adjusted to allow for a desired pump-up time. As the pump-up timer is allowing the system to recycle, the integration timer is reset and the recycling is completed if the requirements of the integration timer are met. Otherwise, the unit is shut down again and the system recycled. A variable electronic scaler is connected to the output of the integration timer which monitors the output signals from this timer.

A reset circuit between the integrator and the scaler resets the scaler to zero after a successful recycle of the system. A successful recycle occurs when fluid is pumped at a flow rate equal to or greater than the present minimum when the pump has been restarted after a shutdown period. If the pumped fluid flow rate achieves the minimum preset flow value during or at the end of the pump-up period, a reset signal is conveyed to the scaler to reset it to zero and continue pump operation and system recycling indefinitely, or until malfunctions interfere with the pumping operation or production drops below a level economically feasible for pumping operations.

When malfunctions do occur, such as parting of the sucker rod, the pumped fluid flow rate will remain below the desired preset value and no reset signal will be conveyed to the scaler. At the end of the pump-up cycle the pump will not be pumping fluids and will be shut down in response to the signal from the integrator assembly. Since there will be no reset signal to the scaler, it will begin to accumulate the shutdown signals. After the preset number of times the integration timer produces a shutdown signal, the scaler turns off the whole system. It can then be restarted manually. This provides a safety device for equipment failure such as breaking of the sucker rod. Means are also provided for recording the various timed cycles and also for monitoring the number of signals transmitted to the scaler, thus being indicative of the number of times the system has automatically shut down and successfully recycled.

Also a circuit is provided to determine the exact percentage of time that the pump is producing fluid flow, whether above or below the preset minimum percentage. A continuous recorder may be used with this circuit to maintain a constant record of the percentage of time the pump is flowing well fluids to allow the operator to determine if the preset minimum percentage should be lowered, and how much it should be lowered to obtain successful recycling of the pumping system.

15 Claims, 10 Drawing Figures

OIL WELL PUMPOFF CONTROL SYSTEM

CROSSREFERENCE TO RELATED APPLICATION

This application is a continuation-in-part of a prior continuation-in-part application, Ser. No. 469,264, filed May 13, 1974, by Bobby L. Douglas, now patent No. 3930752 entitled "OIL WELL PUMPOFF CONTROL SYSTEM UTILIZING INTEGRATION TIMER", which prior application is a continuation-in-part of an original application, Ser. No. 365,881, filed June 1, 1973, by Bobby L. Douglas, now patent No. 3854846 entitled "OIL WELL PUMPOFF CONTROL SYSTEM UTILIZING INTEGRATION TIMER".

BACKGROUND OF THE INVENTION

This invention relates to oil wells and more particularly to an automatic well cutoff system for pumping oil wells.

In the production of oil, a well is drilled to the oil bearing strata. At the bottom of the well, a pump is installed to pump oil to the surface of the earth from the pool that gathers at the bottom of the well. A desirable mode of operation is to pump the oil when ever there is oil in the pool and to stop the pumping when there is no oil in the pool.

Advantages of this desirable mode of operation are that the pump automatically reaches its optimum pumping rate with a result in a saving of man hours and equipment. The pump thus operates at a greater efficiency in pump displacement, thereby reducing the total number of pumping hours which in itself results in a saving of power and power cost.

Those in the prior art have long recognized the desirability of control systems for providing such an automatic pumpoff control of oil wells. Examples of such prior art include U.S. Pat. No. 2,550,093 to G. A. Smith and U.S. Pat. No. 2,316,494 to R. Tipton. In the Smith patent, a valve activates an electrical circuit which causes the pump to be shut down after a predetermined time interval in the event the produced oil ceases to flow through the valve. In the Tipton patent, a clock is caused to run in response to there being no produced fluid, thus causing the pump to periodically cycle in response to the well being pumped dry.

These two patents exemplify the prior art in that various means and systems are provided which monitor the lack of produced fluid and which in turn cause the system to recycle in response thereto.

However, the prior art, to the best of my knowledge, has failed to provide a system which provides satisfactory pumpoff control for the various oil well pumping facilities having varying conditions and components thereof.

A need therefore exists in the oilfield for a means for controlling the operation of oil well pumps in such a manner that the duration of their pumping periods will be substantially or approximately in accordance with the actual time periods required for the pumping off of the wells. Such a need exists for a means of control whereby an oil well can continue in operation so long as it is pumping oil, but which will automatically stop when it has pumped off the oil, or for breakage, in response to cessation of discharge of oil from the pump.

It is therefore the primary object of the present invention to provide a well pumping control system wherein the pump control is a factor of the percentage of time during which oil is being pumped during a given period;

It is also an object of the invention to provide a new and improved well pumping control system wherein the operation of the pump is automatically stopped when the fluid in the borehole is depleted; and Another object of this invention is to provide a system having a variable timing subsystem providing greater flexibility than heretofore known in the prior art.

The objects of the invention are accomplished, generally, by a system which utilizes sensing means to create an event indicative of the well being in a pumpable state. The produced event is utilized in conjunction with a timer which determines the percentage of time during which fluid is being produced, and based upon such determination, either allows the system to continue or to shut down. As additional features of the invention, means are provided for the system to recycle indefinitely as long as there is no malfunction in the equipment and then to completely shut down after a predetermined number of recycles should there be a malfunction in the equipment or should the well drop below a production level which can economically be produced.

These and other objects, features and advantages of the invention will be more readily understood from the following description taken with reference to the attached drawing, in which.

Figure 3:
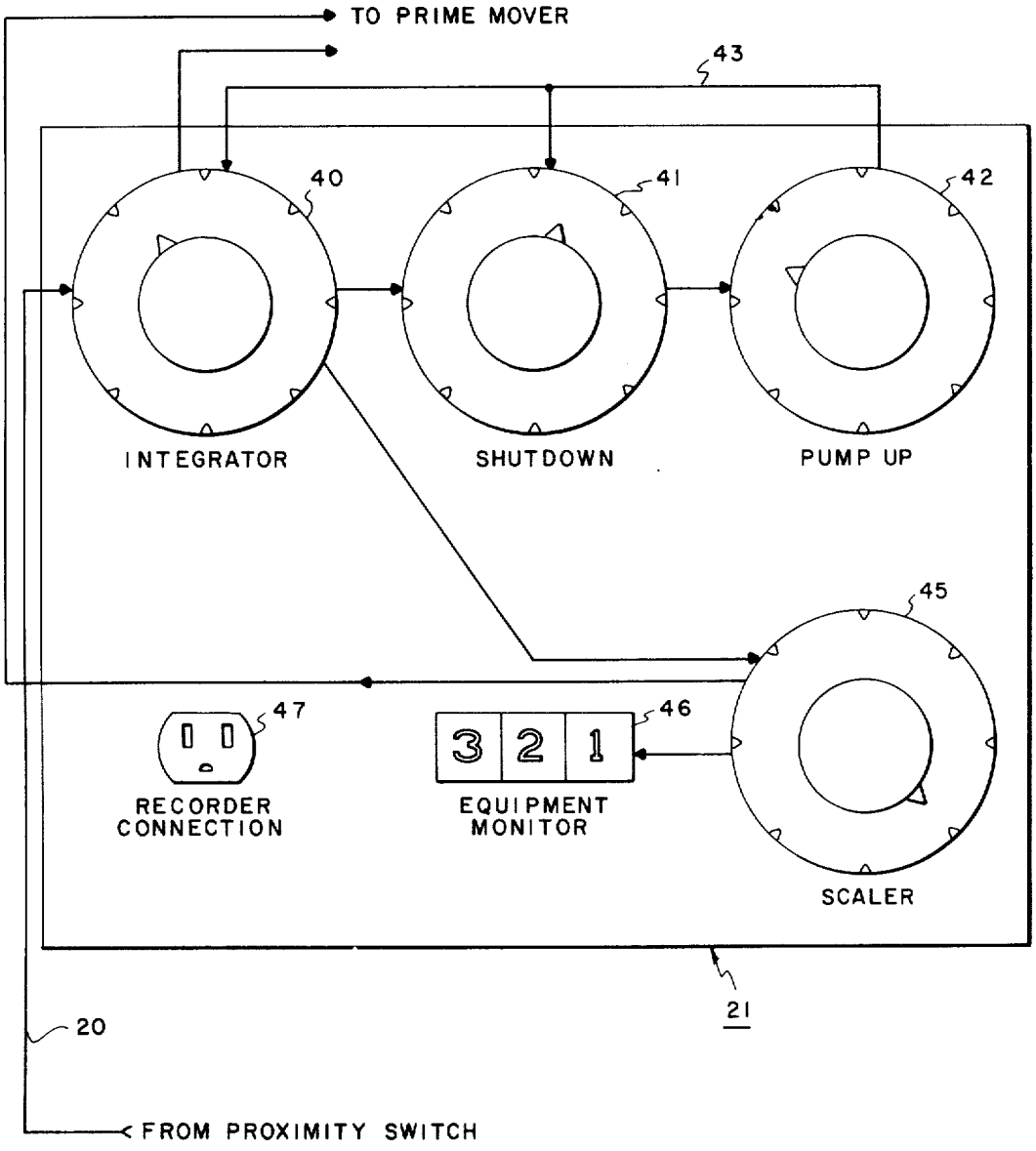
Figure 4:
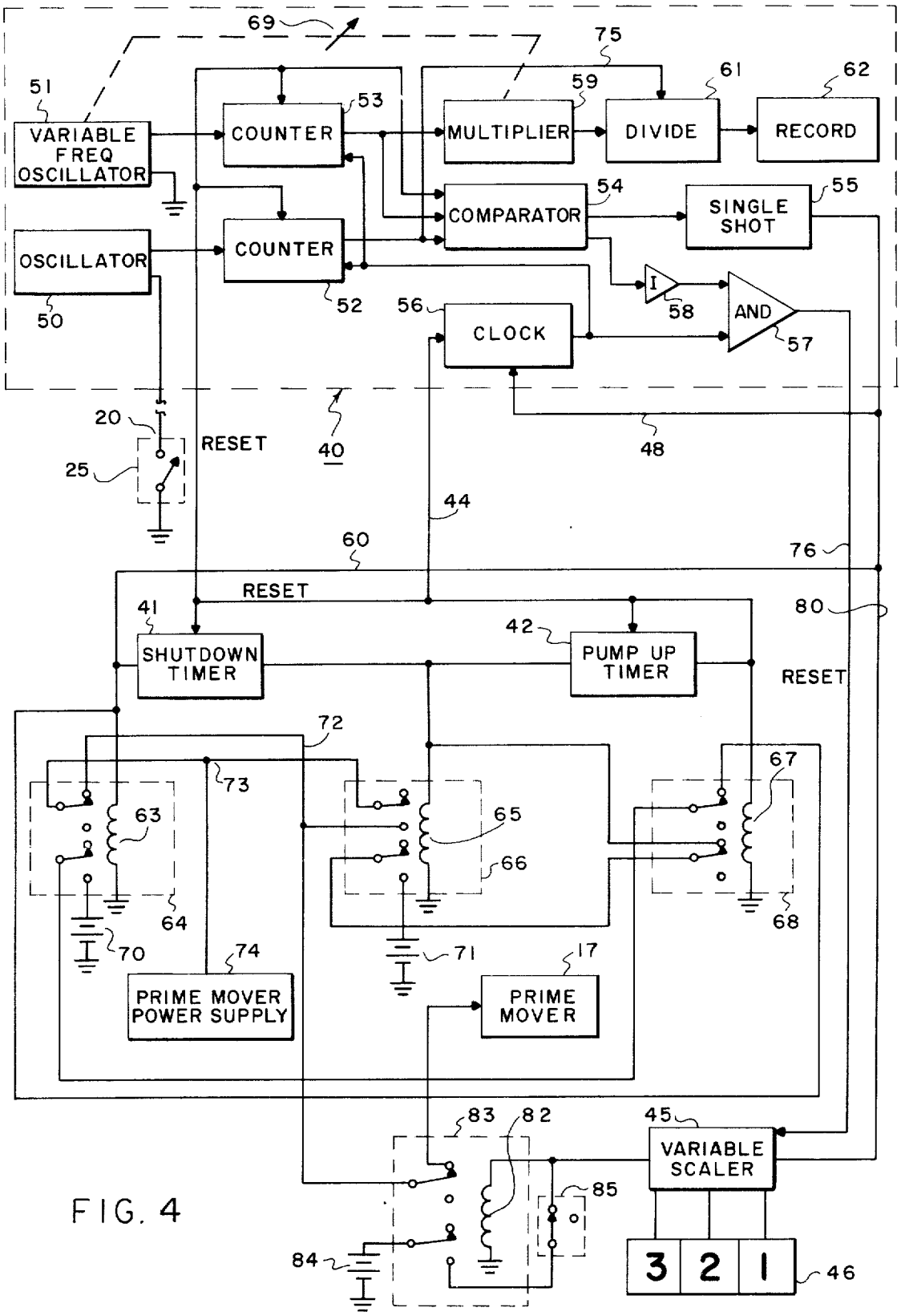
Figure 5:
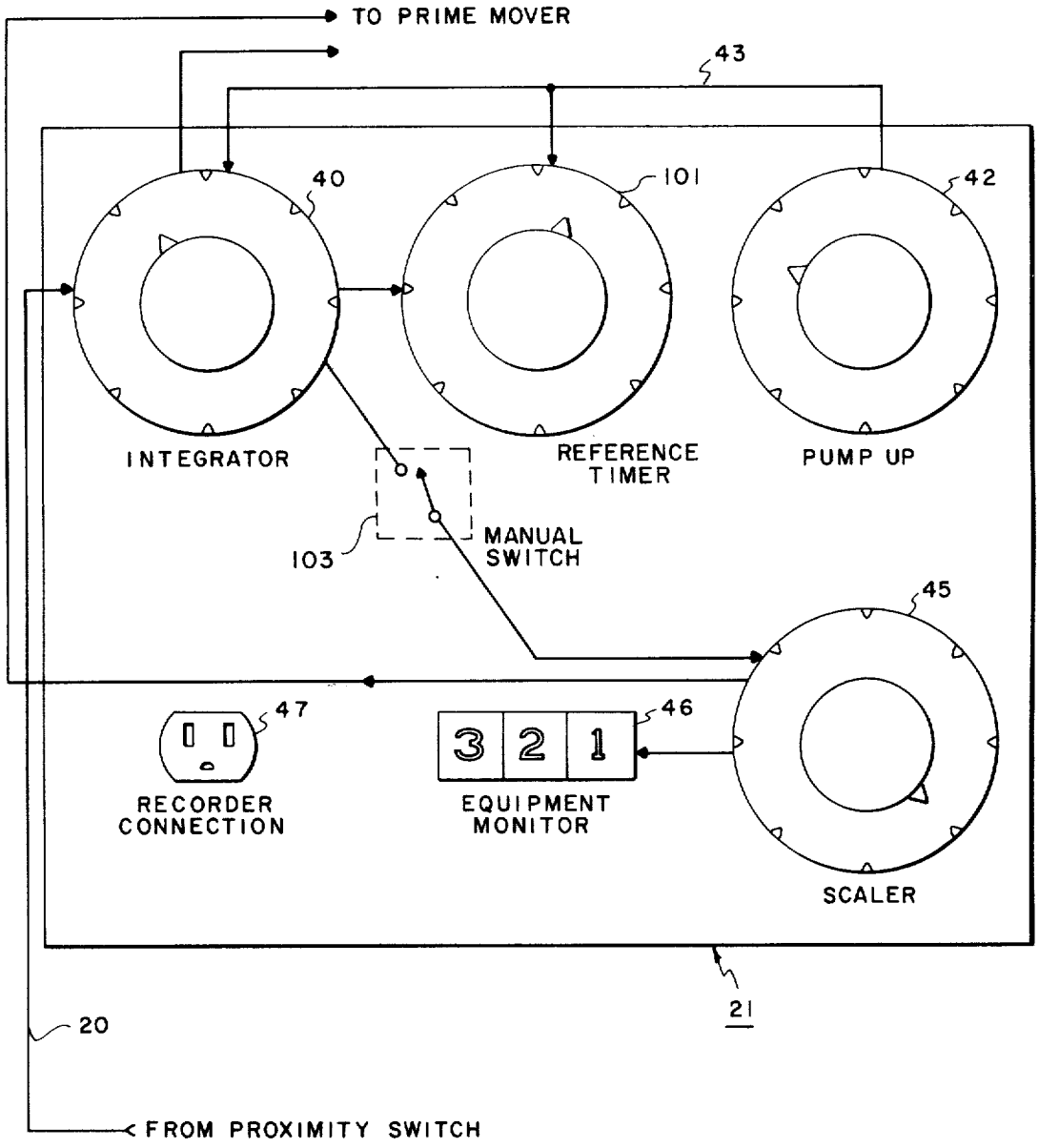
Figure 6:
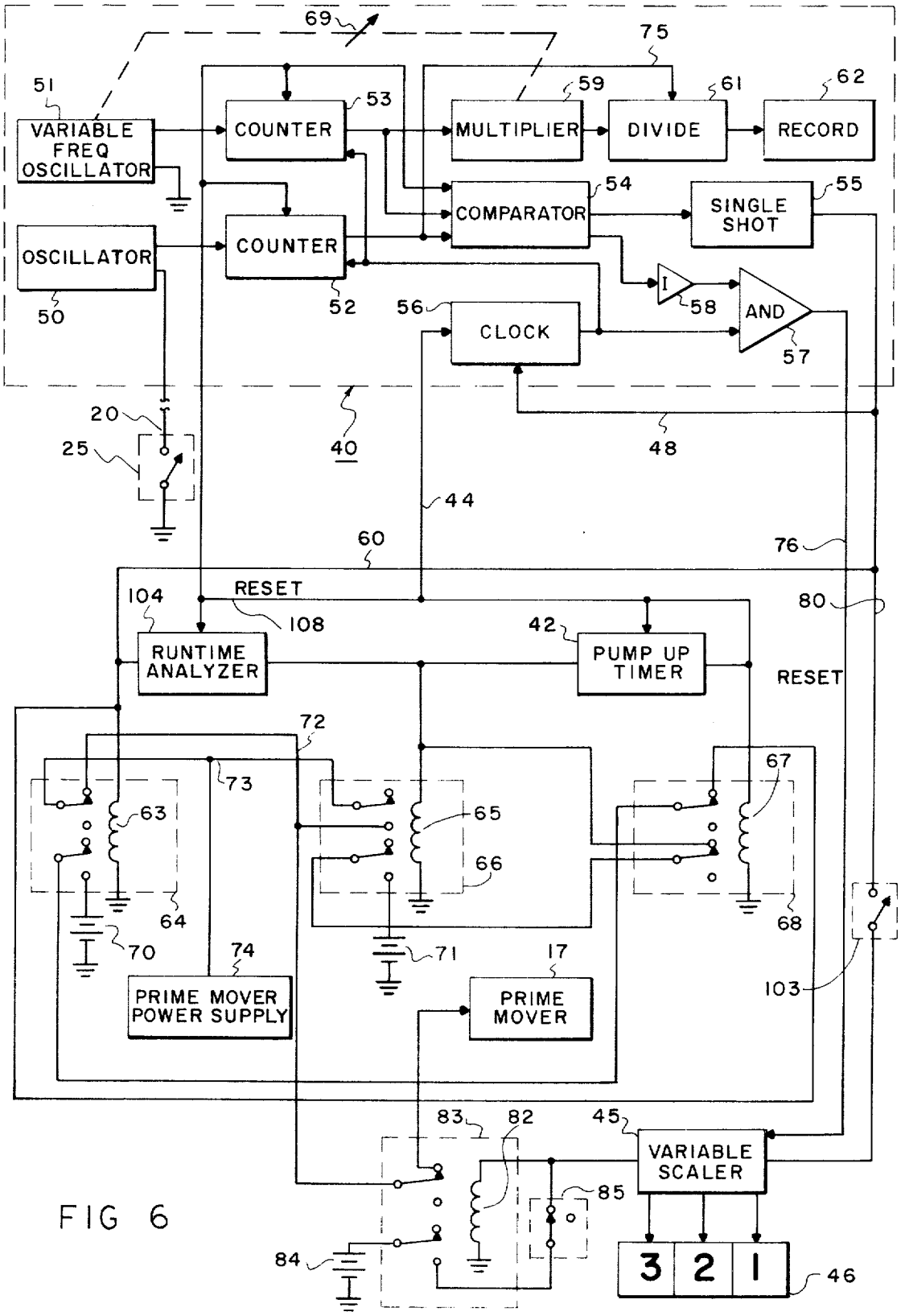
Figure 7:
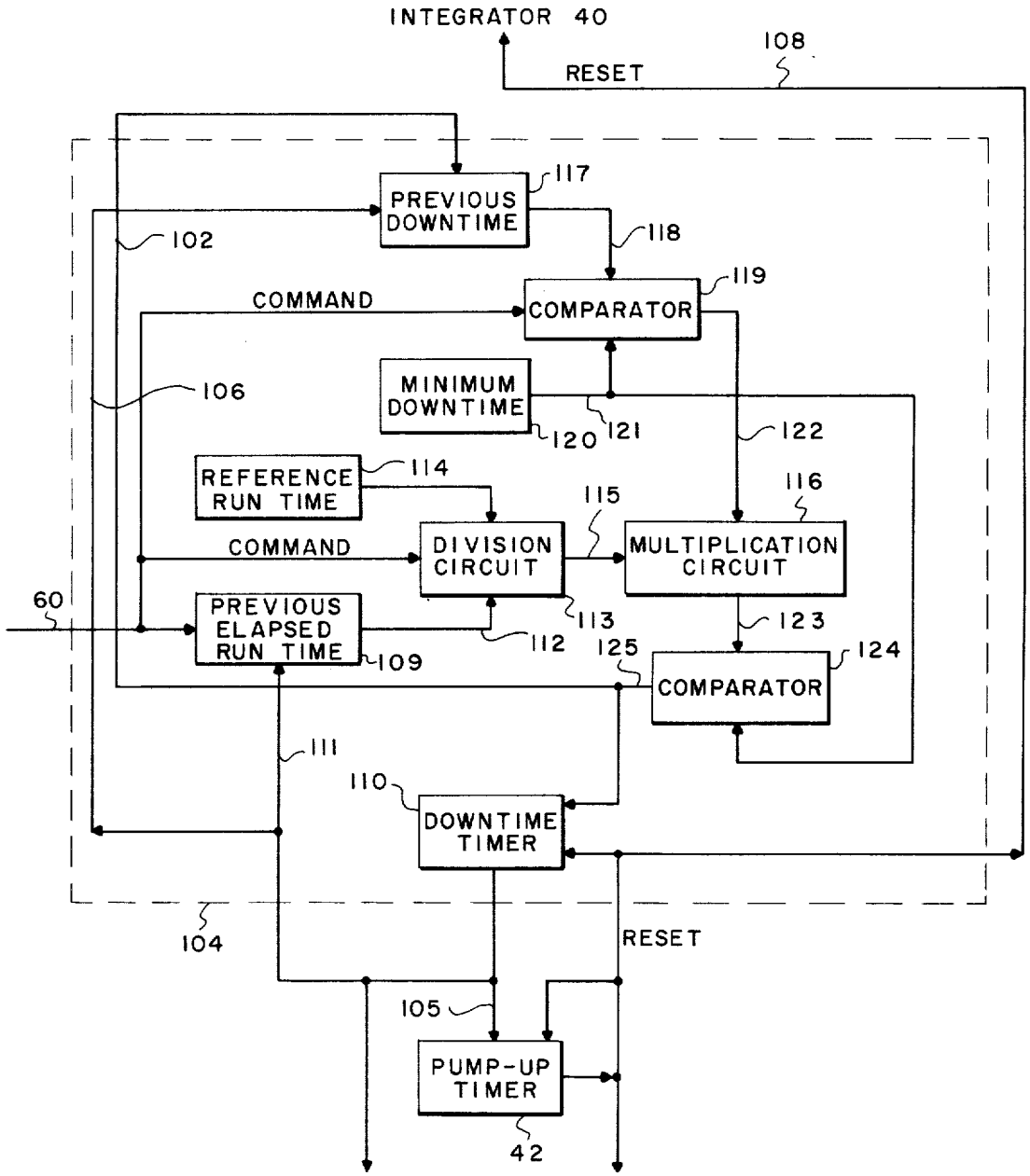
Figure 8:
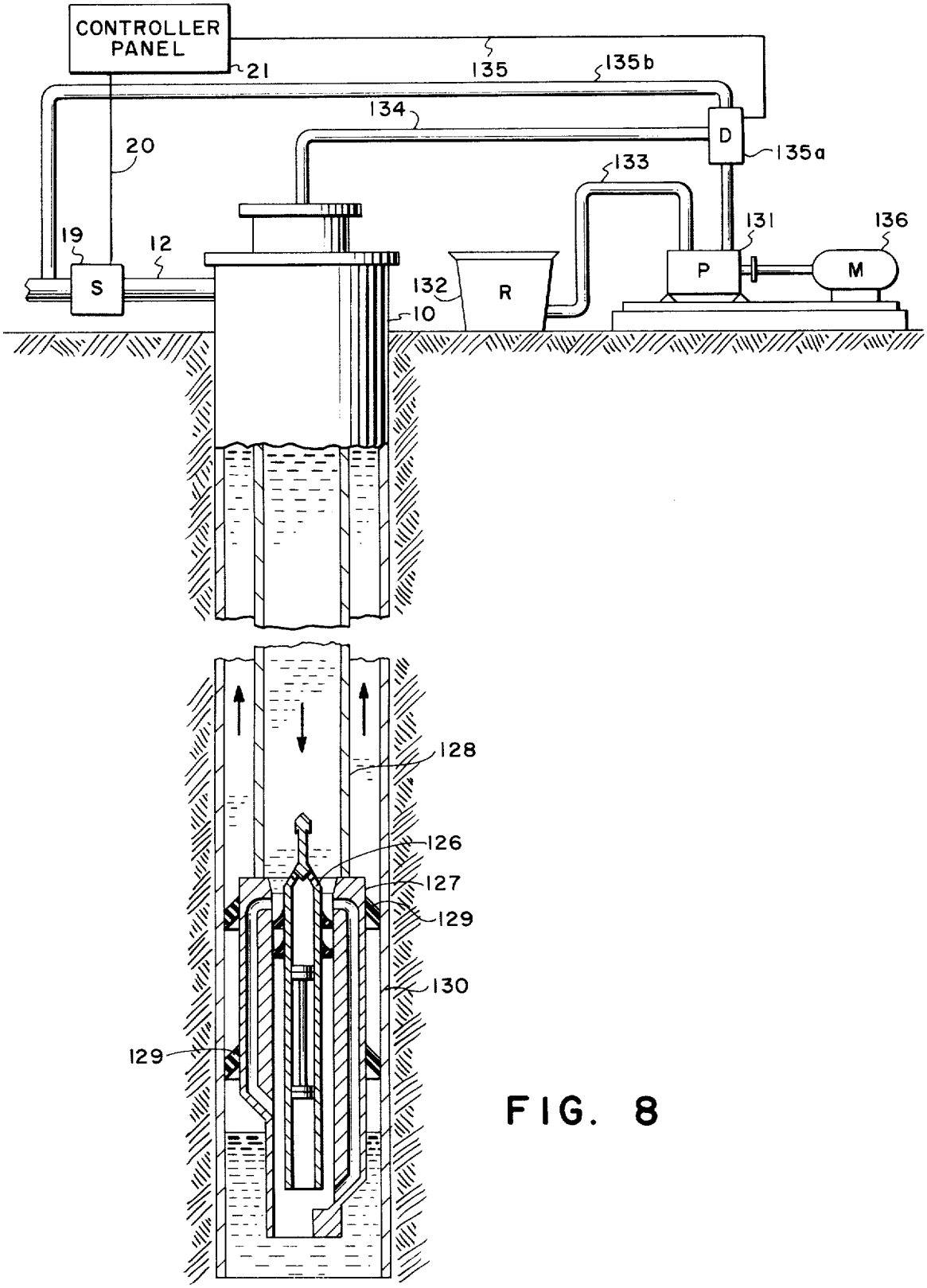
Figure 9:
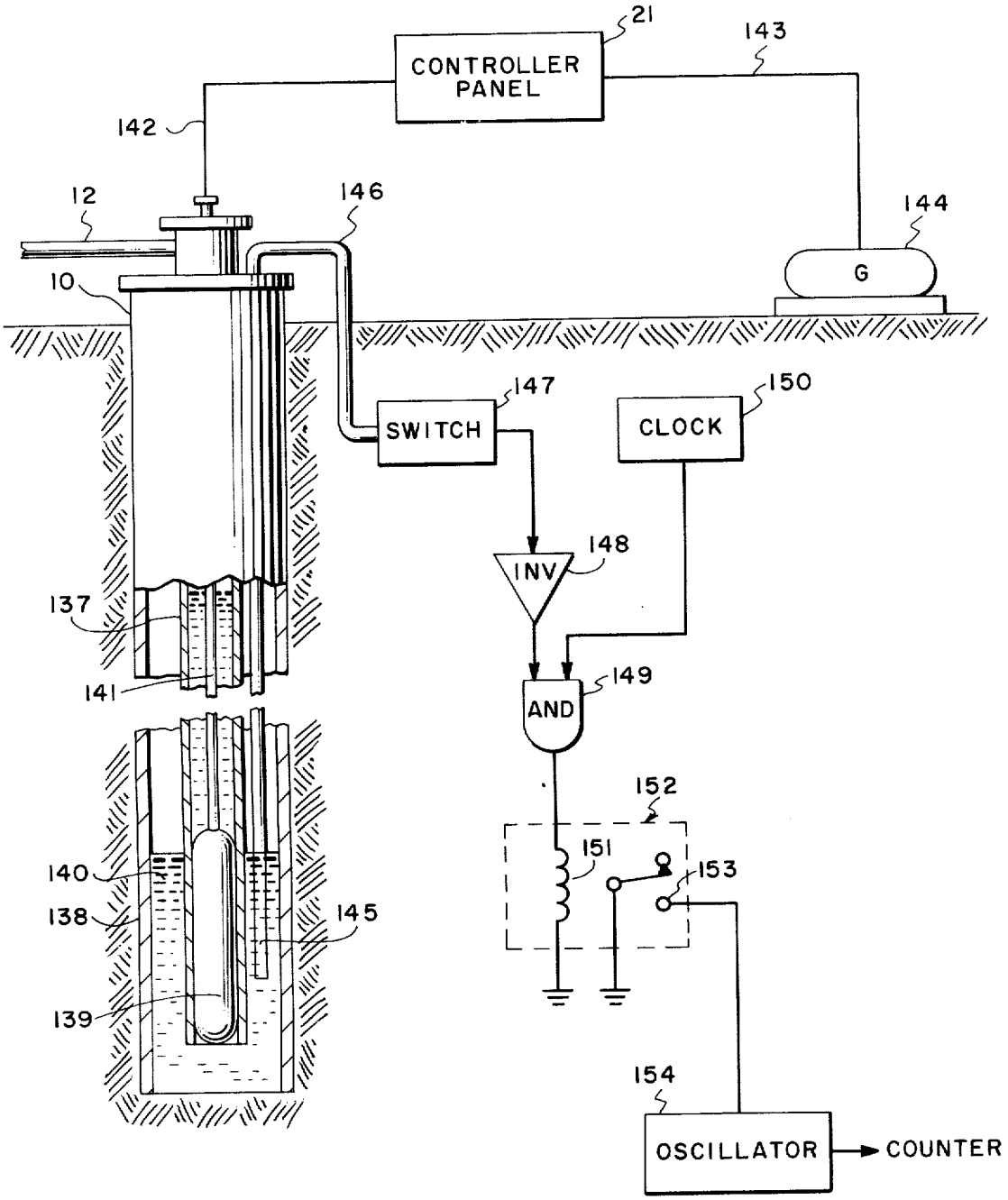
Figure 10:
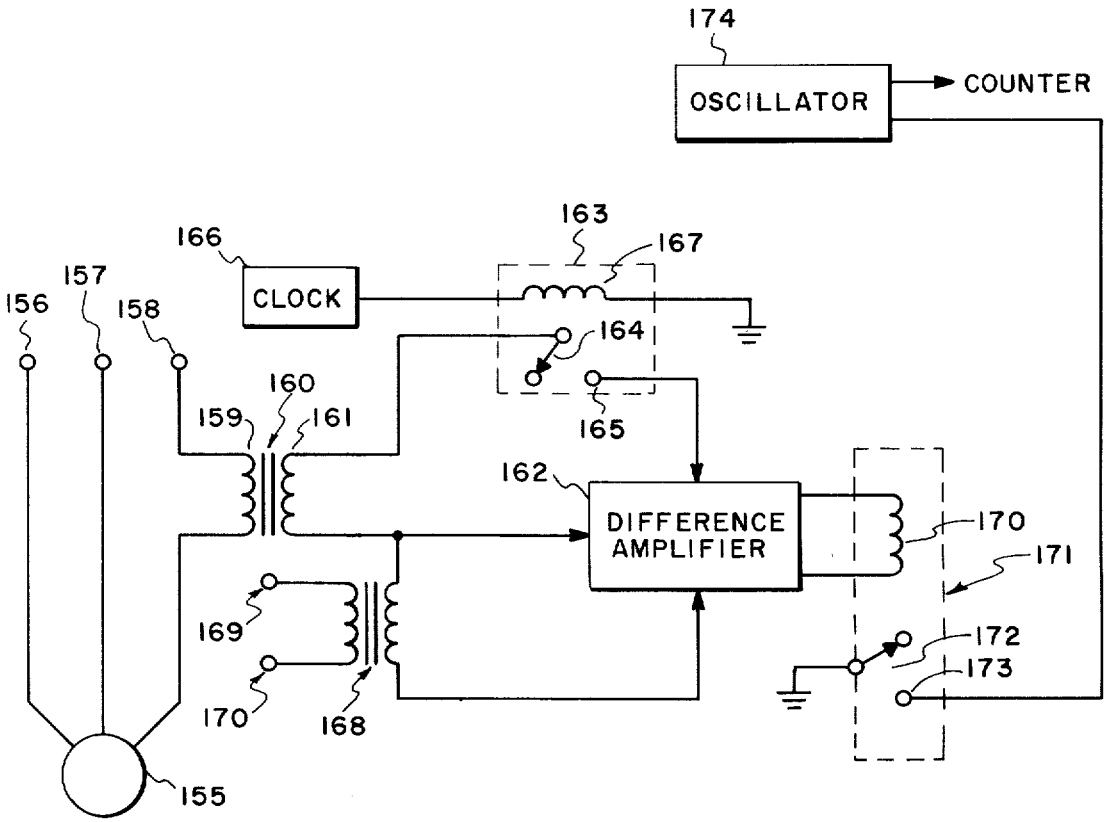

FIG. 3 schematically illustrates the timing system, partly as a flow diagram, according to the present invention; and FIG. 4 schematically illustrates, partly in block diagram, the electrical circuitry of the invention;

FIG. 5 schematically illustrates an alternate timing system partly as a flow diagram;

FIG. 6 is a schematic illustration, partly in blockflow diagram, of the electrical circuitry of the alternate system;

FIG. 7 is a schematic block-flow diagram of the components of the analyzer of FIG. 6;

FIG. 8 shows another type of well pumping installation and another embodiment of the invention thereon;

FIG. 9 shows a third type of pumping installation and yet another embodiment of the invention;

FIG. 10 shows in partial block diagram the electrical circuitry of a further embodiment of the invention.

Figure 1:
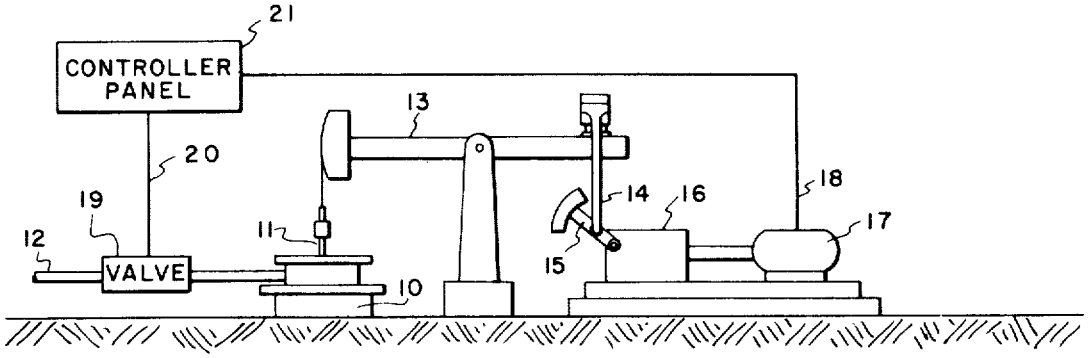
FIG. 1 is a diagrammatic sketch illustrating the component parts of the present invention.

Referring now to the drawings in more detail, especially to FIG. 1, a subsurface pump (not shown) located in well 10 is actuated in a well-known manner by means of a sucker rod string 11, the well fluid lifted to the surface being directed to storage through a pipe 12. The sucker rod string 11 is reciprocated in the well by the offsetting motion of a walking beam 13, which is driven through a pitman 14, crank 15 and speed reducing mechanism 16 by a prime-mover 17 such as an electric motor receiving its power through lead 18. It should be appreciated that any suitable type of motor or engine may be used as the prime-mover 17, for example, a gasoline engine having its energizing ignition current supplied through lead 18.

Figure 2:
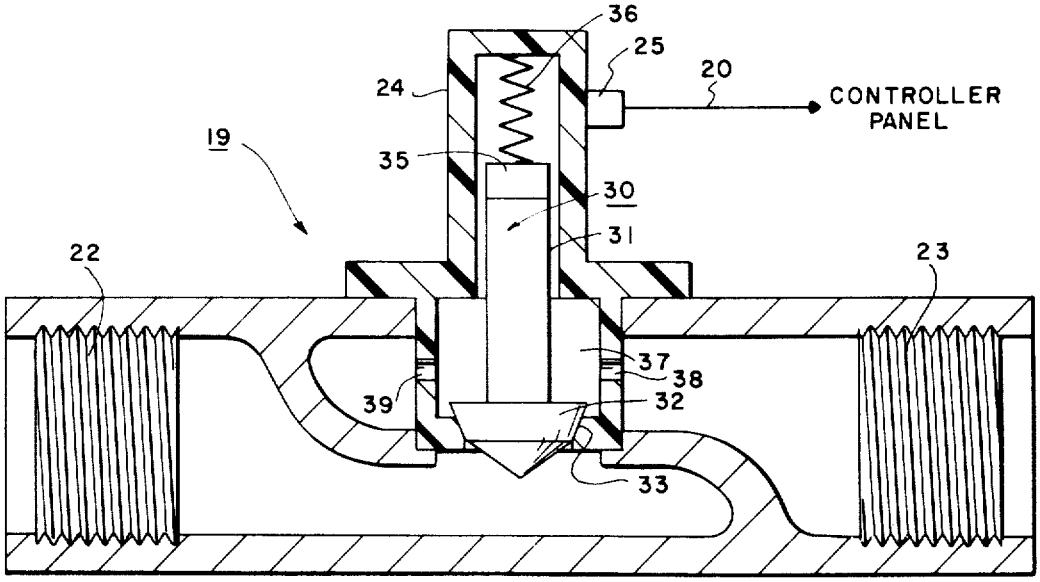
FIG. 2 is a view, partly in cross section, illustrating the valve and sensor means utilized to show produced fluid within the flow line.

A valve assembly 19, shown in more detail in FIG. 2, is located within the pipe 12 and has an electrical conductor 20 leading from the valve assembly 19 to a controller panel 21 shown in more detail in FIG. 3.

Referring now to FIG. 2, the valve assembly 19 is illustrated in greater detail. This valve assembly is substantially cylindrical in shape and has threaded connections 22 and 23 on opposite ends to facilitate assembly within the flow pipe 12 of FIG. 1. A cylindrical valve housing 24 constructed, for example, of plastic and fabricated perpendicularly to the axis between threaded ends 22 and 23, has mounted on its exterior surface a proximity switch 25, for example, a reed switch, having an electrical conductor 20 leading therefrom to the controller panel 21.

A valve 30 is located within the valve housing 24 and has an elongated cylindrical body portion 31 and a frusto-conical sealing section 32 at its lower end adapted to engage a frustoconical valve seat 33 in the lower portion of the valve housing 24. Although the valve 30 could be fabricated in various ways, it should be appreciated that it can be constructed in accordance with my co-pending U.S. Patent Application, Ser. No. 301,557, filed on Oct. 22, 1972, for "DUAL SEALING ELEMENT VALVE FOR OIL WELL PUMPS AND METHOD OF MAKING SAME", assigned to the assignee of the present invention. The full disclosure of said application is incorporated herein by reference.

A magnet 35 is attached to the uppermost section of the valve body 31 and is adapted to close the proximity switch 25 whenever the valve is lifted from the valve seat 33. A non-magnetic spring 36 is used between the upper end of the housing 24 and the valve 30 to spring load the valve 30 into its seating arrangement with the valve seat 33. It should be appreciated that although the housing 24 is illustrated as being of a plastic material, other non-magnetic housings can be used, for example, certain series of the stainless steel family.

The lower section of the cylindrical valve housing 24 above the valve seat 33 is enlarged with respect to the upper section of the valve housing 24, thus forming a chamber 37 for movement of the sealing member 32 as it rises from the valve seat 33. The periphery of such enlarged section has two or more openings 38 and 39 to allow fluid to pass therethrough.

In the operation of the system described with respect to FIGS. 1 and 2, it should be appreciated that as the fluid is pumped from the well 10, it enters the flow pipe 12 and is pumped through the valve assembly 19. In reference especially to FIG. 2, the flow is from the threaded end 22 towards the threaded end 23. Each time the subsurface pump (not shown) causes a surge of fluid, the valve 30 is lifted off the valve seat 33 and the fluid passes out through the ports 38 and 39 and on to the threaded end 23 and out through the flow pipe 12. As the valve 30 is lifted off the valve seat 33, the magnet 35 travels near the proximity switch 25, thereby closing the switch and allowing the conductor 20 to be grounded.

Referring now to FIG. 3, there is illustrated in greater detail the control panel 21. The conductor 20, which is grounded each time the proximity switch 25 of FIG. 2 is closed, is connected into an integrator timer 40, the output of the integrator timer 40 being connected to a shutdown timer 41 whose output is connected to a pump-up timer 42. The output of the integrator timer 40 is also connected to the variable electronic scaler 45 whose output drives a visual monitor 46 bearing the legend "EQUIPMENT MONITOR". The output of the pump-up timer 42, through a reset line 43, causes each of the three timers to be reset upon a recycling of the system. It should be appreciated that the illustration of FIG. 3 is included primarily to show the physical layout of the timing mechanisms and the visual monitor 46. As will be explained in more detail with respect to FIG. 4, the visual monitor 46 has any given number of lights but the preferred number is three, bearing the numerals 1, 2 and 3, respectively.

As previously set forth, the shutdown signal from integrator circuit 40 is communicated to scaler 45 which accumulates these signals. A successful restart of the pumping operation after the shutdown period, which restart features a pumped fluid flow equal to or higher than the present minimum in the integrator assembly, serves to reset the scaler to zero and wipe out any previous accumulated shutdown signal or signals less than three.

The scaler is brought into the operation of the system when the system begins to repeatedly cycle and recycle without ever obtaining a pumped flow rate at least equal to the minimum rate preset into the integrator assembly 40. As the shutdown signals after repeated unsuccessful recyclings are received sequentially by the scaler 45 from the integrator timer circuit 40, the lights in the monitor 46 are activated in succession to indicate the number of times the system has been shut down. For example, during the operation of the system, the first time the system is shut down, the number 1 will be lighted by a red light on the monitor 46 and the numerals 2 and 3 will be sequentially illuminated on subsequent shut downs. A recorder connection 47 is provided for utilizing a strip chart recorder or the like in providing a permanent monitor of the operation of the system.

The integrator 40, shutdown timer 41 and pump-up timer 42 are commercially available from the Eagle Bliss Division of Gulf-Western Industries, Inc. of 925 Lake Street, Baraboo, Wis. 53193, such items bearing the following part numbers: Integrator 40, Part No. HP51A6; shutdown timer 41, Part No. HP510A6; and pump-up timer 42, Part No. HP56A6.

Referring now to FIG. 4, the electrical circuitry of the system is illustrated in greater detail. The proximity switch 25 is shown as applying, upon its closure, a ground to the conductor 20. The conductor 20 is connected to one of the outputs of the oscillator 50 within the integrator timer circuit 40. The oscillator 50 can be set at any frequency desired, but as is explained hereafter, is preferably operating at approximately twice the frequency of the variable frequency oscillator 51. By way of further example, the oscillator 50 has a nominal frequency of 10 kHz and the variable frequency oscillator 51 is set at 5 kHz. The outputs of the oscillator 50 and the oscillator 51 are connected to digital counters 52 and 53, respectively. The outputs of the counters 52 and 53 are connected into a comparator circuit 54. If the output of the counter 53 exceeds the output of the counter 52, as shown by the comparator 54, this is indicative that the system is pumping oil less than fifty percent of the time. In response to such an adverse comparison, the comparator 54 generates a signal which in turn triggers the single shot multivibrator circuit 55 which in turn is connected into other of the components of the circuitry of FIG. 4. Although the oscillator 50 has been described as being set at twice the frequency of the oscillator 51, other frequencies can be used to provide different percentages. Thus, if the oscillator 50 is set at four times the frequency of the oscillator 51, then the system ascertains whether the oil is being pumped 25 percent of the time. It should also be appreciated that it is preferable to provide a comparison over a given period of time; for example, during one minute.

For this purpose, a clock 56 having an output connected to counters 52 and 53 is used to supply the given period of time and can be preset for any desirable time period, such as one minute. The clock runs only during the normal pumping period and is started by the signal output of the pump-up timer 42 transmitted along conductor 44. The clock is stopped by the shutdown signal from multivibrator 55 transmitted along conductor 48.

Counters 52 and 53 can be of the type having conventional shift registers which are clocked out into the comparator 54 upon receiving the clock pulse periodically; for example, every minute. Thus during the time between the termination of the pump-up period and the shutdown signal generated by the multivibrator 55, the clock will transmit output pulses to the shift registers at the predetermined intervals. By then comparing the outputs of counters 52 and 53, the apparatus determines whether the percentage of time the flow valve 30 has been open is at, above, or below the preset value.

This eliminates problems such as might be occasioned by an infrequent gas bubble or the like which might cause the valve to not come off the seat 33 upon any given stroke of the pump. Since a percentage of 50 percent is theoretically the perfect condition, a reasonable setting of the variable frequency oscillator would be 4 kHz in conjunction with the 10 kHz output of the oscillator 50. Under these conditions, a signal would not be produced from the single shot multivibrator 55 until there was a showing that the system was operating less than 40 percent of the time.

The output of clock 56 is also connected to an AND gate 57 which is used in the reset circuit for the scaler 45. A reset line 76 connects the AND gate 57 to scaler 45. The AND circuit receives as a second input, the output from an inverter 58. The inverter receives the output signal from comparator 54, inverts the signal, and transmits it to the AND gate.

The AND gate 57 may be of any of the commercially available logic circuits of this type, which components are known to those skilled in the art.

The particular AND gate utilized is a solid state circuit which, when receiving two input signals will generate an output signal; but when receiving only one input signal or no input signal, will generate no output signal.

The output of the single shot multivibrator 55 is connected by conductor 60 to the input of the shutdown timer 41 which can be adjusted to any predetermined period, for example, four hours. The output of the shutdown timer 41 is connected to the input of a pump-up timer 42 which can also be adjusted to any preselected time, for example, 20 minutes. The shutdown timer 41 and the pump-up timer 42 each contains a single shot multivibrator for producing a single pulse at their respective outputs at the conclusion of the given time periods.

The conductor 60 is also connected to the coil 63 of a relay 64, the other side of the coil 63 being grounded. The relay 64 has a pair of normally open and normally closed contacts. The output of the shutdown timer is also connected to the coil 65 of a relay 66, the other side of the coil 65 being grounded. The relay 66 also has a pair of normally open and normally closed contacts. The output of the pump-up timer 42 is connected to the coil 67 of a relay 68, the other side of the coil 67 being grounded. The relay 68 also has a pair of normally open and normally closed contacts.

The lower normally open contact of relay 64 is connected to a power supply, illustrated as being a battery 70 which is of adequate voltage to maintain the relay 64 in the latched position. The lower normally open contact of relay 66 is similarly connected to a power supply 71 for similar reasons. The upper normally closed contact of relay 64 is connected to a conductor 72 which in turn is connected to the upper normally open contact of relay 66. The upper wiper arm of relay 64 is connected to conductor 73 which is connected directly to the prime-mover power supply 74. The conductor 73 is also connected to the upper wiper arm of relay 66. The lower wiper arm of relay 64 is connected to the upper wiper arm of relay 68. The lower wiper arm of relay 66 is connected to the lower wiper arm of relay 68. The ungrounded side of the coil 65 in relay 66 is connected to the lower normally closed contact of relay 68. The upper normally closed contact of relay 68 is connected to the ungrounded side of the coil 63 in relay 64.

The output of the single shot multivibrator 55 is also connected thru conductor 80 to the input of a variable electronic scaler 45 which, for example, produces one pulse out for each three pulses in from the single shot multivibrator 55. The output of the scaler 45 is connected to the top of a coil 82 of a relay 83, the other side of the coil 82 being grounded. The upper normally closed contact of relay 83 is connected directly to the prime-mover 17. The upper wiper arm of relay 83 is connected to conductor 72. The lower wiper arm of relay 83 is connected to a power supply 84 suitable for latching the relay 83. The lower normally open contact of relay 83 is connected through a spring-loaded normally closed switch 85 back to the ungrounded side of the coil 82 of relay 83.

In the operation of the circuit of FIG. 4, there has already been described the effect of an adverse comparison being made in the circuit 54 to thus produce a single voltage pulse from the output of the single shot multivibrator 55 which occurs on the conductors 60 and 80. Such a pulse appearing on the input of the shutdown timer 41 causes the timer 41 to count for a predetermined time interval, for example, 4 hours. Simultaneously with the production of this signal upon conductor 60, the relay 64 is momentarily energized and latched into a position such that the wiper arms are in contact with the normally open contacts, respectively. The action of the power supply 70 causes the relays to be latched in such a position. This removes the prime-mover power supply 74 from the prime-mover 17 and the pumping action terminates. As soon as the preselected time of the shutdown timer 41 has expired, a single pulse is generated at the output of the timer 41 which activates the relay 66. This causes the relay 66 to latch in position such that the wiper arms are in contact with the normally open contacts, respectively. This causes the output of the prime-mover power supply 74 to be connected to the prime-mover 17 and the pumping action is again commenced. Simultaneously with the activation of the relay 66, the output of the timer 41 is coupled into the pump-up timer 42 which is set for a predetermined time, for example, twenty minutes, and thereafter which generates a single pulse of its own which is coupled back to reset the pump-up timer 42, the shutdown timer 41 and the counters 52 and 53 in the integration timer 40. Simultaneously with this resetting operation, the output of the pump-up timer 42 activates the relay 68 which causes the relays 64 and 66 to be unlatched and their wiper arms to be returned to the positions as illustrated in FIG. 4. This allows the output of the primer-mover power supply 74 to remain connected to the prime-mover 17 and the system has thus been recycled.

Each time the output of the single shot multivibrator 55 produces a voltage pulse on the conductor 80, the pulse is coupled into the variable scaler 45 which is set, by way of example, to produce a single output pulse for each three pulses in. The reset system for scaler 45 operates to send a reset signal to scaler 45 as long as the pump operates efficiently (i.e. above the preset desired level) and prevents the scaler from completely shutting down the pumping assembly. This method of operation can be clearly seen by considering what occurs in the system after the pump-up timer has operated the pump a sufficient time hopefully to fill the tubing with well fluids again after the preceding shutdown period has allowed the pumped fluids to leak back down the well. At the end of the pump-up period, the signal from the pump-up timer will reset the system and will begin clock 56 to running. After the first time period has run on clock 56, a signal is generated by the clock to the counters 52 and 53 and to the AND gate 57. The counters will signal their outputs to the comparator 54 and if the well fluid flow is satisfactory, the comparator will refrain from signaling the multivibrator and no input will occur from the comparator to the inverter 58. The inverter will read the zero signal as a "low level" signal and will invert this to a "high level" signal which will be transmitted to the AND gate. Upon receiving the input signals from the inverter and the clock 56, the AND gate 57 will generate a reset signal which will be transmitted along reset line 76 to the scaler 45, setting the scaler back to zero.

If, on the other hand, the comparator makes an adverse comparison, i.e. the wellfluid being pumped has dropped below the desired flowrate, the comparator will transmit a high level signal to the inverter which, in turn, will signal a zero signal to the AND gate simultaneously with the clock signal, and no reset will be transmitted to the scaler.

After the predetermined downtime has run, if the system again fails to achieve the desired flowrate at the end of the pumpup cycle, the AND gate will again refrain from signaling a reset and scaler 45 will record a second shutdown. Upon a third shutdown of the system under these circumstances, the scaler will completely shutdown the system.

After the system has been unsuccessfully restarted and then shutdown three times, the three pulses produced by the single shot multivibrator 55 will have been transmitted to the scaler circuit 45 which then produces a single pulse at its output and activates the relay 83 which is latched in such a position by the power supply 84. This causes the prime-mover power supply 74 to be removed from the prime-mover 17 and the pumping action is terminated. The system cannot be recycled at this point until the spring-loaded switch 85 is manually activated to the open position to unlatch the relay 83 and thus allow the system to be recycled.

Usually, three recycles of the system without a reset of the scaler indicates pump or sucker rod malfunction or that pumpoff of the well is no longer economically feasible.

After inspecting the physical equipment, if the operator should determine that there is no equipment malfunction, he may wish to set a longer downtime into the downtime timer to determine if the well can still be pumped economically by increasing the downtime, thereby allowing a greater amount of wellfluids to seep into the wellbore before restarting the pump.

Alternatively, rather than having the operator guess at a new downtime, additional circuits may be added to the control system to calculate and continuously record the actual percentage of time that pumped fluid has flowed from the well.

Thus, upon checking the well and discovering that it has been shutdown completely by the scaler circuit, the operator may then check the percentage recorder to see how close to the preset minimum flow rate the actual flow rate was before shutdown. If it appears to be only slightly lower, he may then either increase the preset downtime on the shutdown timer, or alternatively, he may want to reset the minimum percentage by varying the variable frequency oscillator to obtain a minimum percentage just below the actual pumping percentage as indicated by the recorder.

The recording circuit is indicated in FIG. 4 and includes a multiplier 59, a divide circuit 61, a recorder 62, and a gang tuner 69. Multiplier 59 receives the output of counter 53 which counts the variable frequency oscillator output.

The multiplier 59 is a variable multiplier and exhibits a multiplying value dependent upon the frequency selected for the variable frequency oscillator (VFO) and the ratio of the frequency of the VFO to that of the other oscillator 50. The gang tuner 69 is connected to the VFO and the multiplier so that adjustment of the VFO simultaneously makes a corresponding change in the multiplier. The gang tuner is chosen to make the multiplication factor inversely proportional to the VFO frequency.

The amount of multiplication obtained in the multiplier is designed to equal the ratio of the frequency of oscillator 50 to the frequency of the VFO. This offsets the originally adjusted-in disparity between the frequencies of the two oscillators and allows the actual flow percentage to be calculated from the oscillator outputs.

For instance, using the figures of the previous example, with a VFO frequency of 5 kHz, and a frequency of 10 kHz in oscillator 50, the multiplier will utilize a multiplication factor of 10 divided by 5, or 2. This adjusts the ratio of oscillator frequencies back to where a direct flow percentage may be calculated. Calculation of flow percentage is achieved in the divide circuit 61 which receives as inputs the outputs of multiplier 59 and counter 52. The output of counter 52, transmitted to the divide circuit by conductor 75, is divided by the output of multiplier 59 to obtain the exact flow percentage.

This percentage is transmitted from the divide circuit to a recorder 62 which preferably has a visible, lighted panel showing the instant flow percentage if the pump is presently running, or the last calculated percentage of the immediately preceding cycle when the pump is shutdown. The recorder also preferably utilizes a chart or graph recorder to maintain a continuous written record of the pumping efficiency to allow the well operator to review past pumping operations.

The components utilized in the gang tuner, multiplier, divide circuit, and recorder are readily known to those skilled in the electronics art and are obtainable commercially.

For example, with an integrator circuit utilizing an oscillator 50 with a frequency of 20 kHz and a setting on the VFO of 7 kHz, the pumpoff control system is set to shutdown the system when the pumping efficiency drops below 35%. This is determined by the calculation:

$$\frac{7\text{kHz}}{20\text{kHz}} \times 100\% = 35\%$$

Should the pump be pumping fluid at a rate greater than 35% and then drop to a level such as 33%, the system would recycle as previously described. If, during the subsequent pump-up cycle, the flow rate should reach only 33%, then at the end of the pump-up period the system will shut down and no reset signal will be conveyed to the scaler. After three unsuccessful recycles during which the flow rate never exceeded 33% during the pump-up period, the scaler will completely shut down the system, requiring a manual reset and restart of the apparatus.

During the pump-up period when the flow rate is 33%, the VFO will be generating a signal with a frequency of 7 kHz, and, during one time period (60 seconds) of clock 56, will emit $7 \times 1000 \times 60$ impulses, or $4.2 \times 10^5$ impulses. The oscillator 50 will emit $20 \times 1000 \times 60 \times 0.33$ pulses, or $4.0 \times 10^5$ pulses. Since counter 53 registers a greater number of pulses than counter 52, comparator 54 generates an adverse signal and the system is shutdown at the end of the pump-up period.

Prior to the pump-up period, the setting of the VFO and the frequency of oscillator 50 have determined a frequency ratio of 20/7. The setting of the VFO operates via gang tuner 69 to obtain a multiplication factor of 20/7 (approx. 2.86) in the multiplier 59. During the pump-up period, the count of counter 53 from the VFO is multiplied in the multiplier by 2.86 to obtain a count of $2.86 \times 4.2 \times 10^5$ pulses, or $1.2 \times 10^6$ pulses. The divider then divides this sum into the number from counter 52 thusly, $$\frac{4.0 \times 10^5}{1.2 \times 10^6}$$

and obtains a percentage of 33, which as noted earlier, is the actual pumped flow percentage achieved during the pump-up period. This figure will be visible on the display panel as well as being recorded on a chart or graph.

The operator may then want to increase the downtime period or change the VFO to a frequency below 33% of that of the oscillator 50. For instance, a VFO frequency of 6 kHz would give a minimum flow percentage of 30% and would allow the pump to operate and cycle successfully at the 33% level.

In FIGS. 5, 6, and 7 a second pumpoff control system is illustrated wherein the shutdown timer system is replaced with a runtime analyzer to further optimize pumping operations at the well. Instead of using a preset downtime such as was obtained by the setting of timer 41, this system, utilizing the runtime analyzer, calculates the ratio of a preset desirable runtime to the actual runtime of the previous cycle, and, calculating the upcoming downtime by multiplying the previous downtime by this ratio, adjusts the actual runtime indirectly by varying the downtime to achieve an actual runtime as close as possible to the desirable preset runtime.

Thus, by adjusting the preset desirable runtime over an extended period of time, the operator can determine the longest period of runtime obtainable without causing a disproportionate increase in the downtime required to maintain that runtime. This optimizes the pumping efficiency and minimizes the number of times per day the pumping system will be cycled on and off.

For example, with a low pressure producing well which has to be pumped for production and the maximum amount of oil that will seep into the borehole from the formation during a 24 hour period being about 500 barrels, with a 1500 barrel per day pump the optimum runtime of the pump would be 8 hours per day. But it is obvious that the pump cannot be simply turned on for 8 straight hours and then shut off for 16 hours each day because, due to the low formation pressure, the borehole cannot accumulate 500 barrels of oil at one time no matter how long the pump is shut down.

Thus, the pump must be run for a period of time equal to approximately one-half the time required for the borehole to fill up to its highest level under the existing formation pressure, since, in this example, the optimum runtime is one-half of the optimum downtime.

Other wells may exhibit different ratios, for instance a 1000 barrel per day well with a 2500 barrel per day pump would have an optimum runtime - downtime ratio of 2:3. When the time is determined for the borehole to fill with well fluids to its highest level, then this is the optimum downtime and the runtime of the pump should be two-thirds of this optimum downtime.

The system operates upon the basis of the following equation:

$$t_n = \left(\frac{T_s}{T_{(n-1)}}\right) t_{(n-1)};$$

where $t_n$ = time of the upcoming downtime period;

$T_s$ = reference pump running time set manually by the operator on a variable timer;

$T_{(n-1)}$ = elapsed runtime of the immediately preceding pumping cycle;

$t_{(n-1)}$ = downtime of immediately preceding pumping cycle.

This equation if used in the runtime analyzer to vary the downtime, $t_n$, to achieve an actual runtime $T_{(n-1)}$ as close as possible to the preset desirable runtime $T_s$.

Looking at FIG. 5, a schematic layup of the control panel of this system having a partial flow diagram is shown. An integration timer 40 identical to that of FIG. 3 has an output directed to the reference runtime timer 101. The panel also has a pump-up timer 42, a scaler 45, equipment monitor 46, and recorder connection 47. A manual switch 103 is located in the output conduit from the integrator 40 to the scaler 45 to allow the scaler and automatic shutdown subsystem to be manually cut out of the control system.

Referring now to FIG. 6, the partial schematic flow diagram of the circuitry of the system is illustrated. The integrator circuit 40 is identical to that of FIGS. 3 and 4. The output of the single shot multivibrator 55 moves through conductor 60 to a runtime analyzer 104 shown in more detail in FIG. 7. Analyzer 104 utilizes the previous runtime, reference runtime, and previous downtime in the formula explained above to calculate a new downtime for the present cycle. It should be noted here that the previous runtime was terminated exactly as it was in the system of FIGS. 1–4, that being by a signal generated in the integrator circuit when pumping efficiency dropped below the predetermined level set in the variable frequency oscillator 51. The reference runtime does not directly affect the actual runtime but is an arbitrary desirable figure chosen by the operator.

Almost simultaneously with the signal from the multivibrator 55, the analyzer 104 calculates the downtime and sets the downtime timer running.

The shutdown signal from multivibrator 55 to relay 64 energizes the coil 63 therein and moves the upper wiper arm of relay 64 to the normally open contact thereby breaking the circuit from the prime-mover power supply 74 to the prime-mover 17, shutting down the pumping apparatus. Energizing coil 63 also moves the lower wiper arm of relay 64 to the normally closed contact thereby placing voltage source 70 into contact with the ungrounded side of coil 63 via relay 68. This maintains coil 63 energized and locks relay 64 into this position thereby maintaining an open switch between the prime-mover and its power supply.

Upon completion of the downtime phase of the cycle, as calculated by analyzer 104 and obtained by the downtime timer therein, a second signal is generated which moves along conductor 105 to coil 65 of relay 66. This moves the upper wiper arm of relay 66 from the normally open contact to the normally closed contact thereby creating a circuit from the prime-mover power supply 74 to the prime-mover 17. Simultaneously, the lower wiper arm of relay 66 moves downward from the normally open contact to the normally closed contact thereby placing voltage source 71 in communication with the ungrounded side of coil 65 via relay 68. This maintains coil 65 energized and locks relay 66 into this position, momentarily, thereby supplying power to the prime-mover once again for pump operation during the pump-up period.

Upon running of the pump-up period, as determined by the preset pump-up timer, a signal is generated by the pump-up timer and transmitted to coil 67 of relay 68, energizing the coil, and moving the upper and lower wiper arms to the normally open contacts associated therewith. Movement of the lower wiper arm to the normally open contact breaks the circuit from the voltage source 71 to coil 65, thereby deenergizing the coil and allowing the wiper arms to return to their upper positions. This breaks the temporary circuit from the prime-mover 17 to its power source.

The movement of the upper wiper arm of relay 68 to the normally open contact in response to energization of coil 67 by the pump-up timer 42 breaks the circuit from voltage source 70 to coil 63. This deenergizes coil 63, allowing the wiper arms to return to their upper contacts, thereby reestablishing the normal power supply circuit from power supply 74 to the prime-mover 17 via the upper wiper arm and the upper, normally closed contact of relay 64.

During the pump-up cycle the pump is run without regard to the amount of fluid being produced. The shutdown circuit is temporarily removed from the pumping circuit to allow the pump to run long enough to bring fluid all the way back up the borehole and out the flowpipe to the flow sensing means. This is necessary because most of the fluid left in the wellbore above the pump from the previous pumping cycle will eventually, during the shutdown period, leak back around the pump and go back down into the formation.

Excluding the shutdown mechanism from the pump-up period allows the pump to run the entire pump-up period and obtain a flow of wellfluids before activating the cycling circuits again.

At the point where the pump-up period ends and wellfluids are being pumped again, the integrator circuit is reset and pumping will continue until the flow sensing means 19 signals to the integrator 40 that fluid flow from the well has dropped below the preset desired level, at which time the shutdown cycle will begin again with a newly calculated downtime value.

It should also be noted that the output signal of the downtime timer in the analyzer is also returned to the analyzer as a reset signal along a conductor 108.

Referring now to FIG. 7, a partial schematic flow diagram of the runtime analyzer 104 is shown in which the abovementioned calculation is performed. The analyzer has a previous elapsed runtime module 109 for receiving the shutdown signal along conductor 60 from multivibrator 55 and also the startup signal from the downtime timer 110 along conductor 111. Utilizing the shutdown signal from integrator 40 and the signal from timer 110 as input signals, the module 109 generates an output signal linearly proportional to the time lapsed between the two input signals and transmits the output signal along conductor 112 to a division circuit 113. This output signal could be, for example, an electrical signal such as a linear ramp voltage.

A reference runtime module 114 is also applying a signal such as a linear ramp voltage to the division circuit, with the reference signal from circuit 114 being determined by the operator who presets the value into the analyzer by variable control means such as a rheostat. The reference runtime signal may be a continuous signal or can be a pulse signal generated by command from either module 109 or integrator 40.

The division circuit divides the reference runtime value by the previous runtime value and generates a signal proportional to this quotient and transmits the signal via conductor 115 to a multiplication circuit 116. A previous downtime module 117 simultaneously calculates the downtime of the immediately previous cycle from inputs received along conductor 106 from the downtime timer 110, and conductor 102 from a comparator 124, and generates a signal proportional to the previous downtime, transmitting the signal via conductor 118 to a comparator 119. A minimum downtime signal generator 120, which can be varied by the well operator, also generates a signal proportional to this preset minimum downtime, which signal is transmitted via conductor 121 to the comparators 119 and 124. The comparator 119 receives the two signals described and transmits the larger of the two received signals via conductor 122 to the multiplier 116 which receives the compared downtime value and multiplies it by the quotient of the reference runtime by the previous runtime as indicated by the signal from the division circuit 113.

It should be noted that during initial startup of the system, the previous downtime is zero, therefore comparator 119 utilizes the preset minimum downtime to relay to the multiplication circuit 116.

The result of the multiplication is the generation of a new signal indicative of the newly calculated downtime, which signal is conveyed via conductor 123 to a comparator 124 which compares it to the preset minimum downtime signal received from the minimum downtime signal generator 120 via conductor 121. If the new downtime is greater than the preset minimum time, the comparator relays this value to the new downtime timer 110 via conductor 125, otherwise, the minimum downtime value is transmitted to the downtime timer. The new downtime signal starts the downtime timer running while simultaneously setting the length of time the downtime timer is to run. The downtime timer can be any device which receives a linear electrical signal such as a linear analog voltage.

After the downtime timer has run the length of time required, the startup signal, as previously described, is generated and transmitted via conductor 105 to the pump-up timer 42. This starts the pumping apparatus back up as previously described.

After the pump-up period is completed, the prime-mover will then continue to operate on this second cycle until the flow production drops below the desired percentage set into the integrator 40 at which time the above shutdown cycle will occur again.

As an example of the above operation in a hypothetical well, the well operator chooses a reference runtime of 1 hour, a minimum pump flow of 40%, and a minimum downtime of 2 minutes. The system is energized and the pump operates for 3.5 hours before dropping below the desirable 40% level at which time the integrator signals the shutdown of the pump prime-mover. Since this is the initial cycle, the comparator 119 signals a time of 2 minutes (minimum downtime).

The calculation performed by the analyzer will be thus:

$$t_1 = \left(\frac{Ts}{To}\right) \text{to}$$

$$t_1 = \left(\frac{1.0}{3.5}\right) 2 \text{ min}$$

Since the newly calculated downtime $t_1$ for this cycle is less than the minimum downtime, comparator 124 will signal a new downtime of 2 minutes to the downtime timer 110.

On the next cycle the pump runs for the 20 minute pump-up period, at the end of which production is below 40% and the system shuts the pump down. The new downtime is calculated:

$$t_2 = \left(\frac{1.0}{0.33}\right) 2.0 = 6 \text{ minutes.}$$

After the 6 minute downtime, the pump again runs for the 20 minute pump-up period and 4 additional minutes before the system shuts it down, and $t_3$ is calculated as:

$$t_3 = \left(\frac{1.0}{0.4}\right) 6$$

$$t_3 = 15 \text{ minutes.}$$

The system will continue to cycle as the well is repeatedly pumped below the 40% flow capacity. The downtime will be varied until the actual runtime approaches one hour as previously determined desirable.

When the downtime has stabilized, for example at 45 minutes and the well operator has observed this leveling off, he can then take the ratio of actual ontime, 1 hour, to stable downtime, 45 minutes or: 1.0/0.75 = 1.33, and raise the reference runtime; for example, to 2 hours. If, after the control system has once again stabilized, and the ratio of runtime to downtime has not varied too much from the 1.33 calculated with the previous runtime of 1 hour, he may want to leave the runtime at 2 hours or, he may want to try to increase the runtime again to see if the ratio remains unchanged with an even longer runtime.

Over a period of several weeks or months as the oil level in the formation near the well begins to drop appreciably, the operator may have to cut back the reference runtime if he notes a significant increase in downtime to maintain the previously arrived at optimum ontime.

From the description above it is clear that further modules could be added to the analyzer circuit 104 to automatically adjust the reference runtime to an optimum value as it was done manually at the end of the hypothetical example above. This would require a division circuit module to obtain the ratio of actual runtime to latest downtime and retain these ratios until a maximum is reached, then automatically adjust the reference runtime upward until a predetermined deviation downward from the maximum ratio $$\frac{T(n-1)}{t(n-1)}$$

occurs, for example, a 10% decrease in the optimum ratio.

It is clear that one skilled in the electro-mechanical arts could arrive at such a modification utilizing known components and the structure of the apparatus herein disclosed.

Also, while the above examples and embodiment of the invention utilized the immediately preceding elapsed pump runtime to calculate the new downtime, it is possible to utilize any other elapsed previous runtime than the immediately preceding one. Alternatively, circuits could be provided to utilize an average of any two or more previous elapsed runtimes to calculate the new downtime.

It should also be noted that whereas only a minimum downtime regulating means is disclosed, it would be possible to utilize additional circuits to allow a maximum downtime to be set for the cycles. This could also be made inherent in the circuits previously described; for example, the downtime timer could incorporate such a limitation and it could be made variable at the well operator's control.

ADVANTAGES OF THE INVENTION

In order to produce a well at its maximum rate, the downhole pump and surface equipment must raise the fluid to the surface just as fast as the formation will give it up. This would be very easily accomplished if well conditions never changed, and if downhole and surface pumping equipment could be sized exactly to each individual well. Since oil wells and oil field equipment rarely behave like laboratory models, the industry has been faced with pumping problems ever since the first rod pumped well was connected to a flowline.

Normally, if the well operator has installed and adjusted his pumping equipment to produce a well at its absolute maximum rate, the bottom hole fluid level is so low that most of the time the subsurface pump is not being filled to capacity on each stroke and the well is "pumping-off". When this condition exists, fluid pound occurs and equipment starts breaking due to excessive stresses. If there is enough equipment available to pump the well down and it is not "pumping-off", then the well is not producing at its absolute maximum capacity and adjustments need to be made.

In a well which has the capability to "pump-off" this invention will detect and make appropriate corrections for two major conditions. First, when the well is pumping down, the system will detect the "pumped-off" condition; automatically regulate the pumping time to pump only when fluid is available; and stop pumping when sufficient fluid is not available to fill the subsurface pump thus reducing the occurrence of rod parts and equipment breakage. Secondly, the system will shut down the pump and signal the well operator whenever there is a lifting equipment failure which will require remedial action or replacement.

For wells which are prolific producers or where it is not economically practical to install large enough equipment to keep the well pumped down, the present invention affords the well operator a means of detecting developing decreases in lifting efficiency and a means of quick detection of problems which require immediate attention. Without an automatic detection system, the normal response time for a well which has gone off production runs anywhere from 15 hours to 2 weeks. With this system, response time for any well should be shortened to a minimum of just a few minutes where a central monitoring station is set up, or a maximum of 24 hours where a once-a-day visual well check by the pumper is used.

Since the system recognizes a pumped-off condition within the first minute of pump nonfilling, fluid pound is reduced to a bare minimum. By not allowing the well to pound fluid more than a minute, sucker rod life is extended, tubing parts are reduced, downhole pump and pumping unit service is lengthened, and the well operator's cost per barrel of crude is reduced.

Whenever a well has parted the sucker rods, worn out the stuffing box, has tubing leaks, or when the pump gas locks, very little, if any, fluid will be put into the flowlines. When any of these conditions exist, the pumping unit is shut down.

For easy detection of a nonproducing well, the control panel also has an external green light which goes off only when the nonproduction cycle counter has exceeded the preset number of cycles and has shut the pump down permanently.

A reduced production capability can be recognized by the pumper as he records the production monitor reading daily. The monitor advances one count everytime the pump is shut down by the control panel. Since this is the accumulated numbers of shutdowns, the pumper can tell every day how long the pump was down during the past 24 hours by taking the difference of the numbers every day. If the number of shut down periods start increasing markedly, this should alert the pumper that the well is not capable of producing as much fluid as previously.

If the pumper notices a marked decrease in the number of times the pump has been shut down, this indicates that more fluid is being produced. This will be especially advantageous in waterflood projects where the production of a well can change daily. This is one of the greatest benefits of the production monitoring system in that it will keep the pump running as long as fluid is available to be pumped. It only shuts down the pump when there is insufficient fluid to fill the subsurface pump.

As slippage between plunger and barrel increases due to normal pump wear, slightly less fluid is produced on every pump stroke. When this slight loss of production is multiplied by eight to 17 thousand pump strokes per day, the total production loss becomes considerable and worsens as pump wear continues. This increasing loss in pump efficiency can also be recognized with the production monitoring system. Under these conditions, the production monitor will register a fewer number of shutdown cycles per day and the percent production reading will also be lower. The pump efficiency can be determined by using this information and repairs can be made to remedy the problems.

The production monitoring system can also be applied to wells which do not normally pump off. Under these conditions, the device is used to monitor the pumping equipment and shut down the unit should there be a rod part, tubing leak or stuffing box failure. If a shutdown is registered, then a problem is indicated which should be immediately investigated. If there is no surface pumping equipment or rod string problem located, then the shutdown would indicate that the pump efficiency has decreased and repairs should be made to prevent further loss of production.

The system is designed so that whenever there is a power failure (such as electrical storm), the pumping unit will not come on immediately when power is restored. The control panel will start on the last digit of the down-time cycle, so that all wells do not start up simultaneously and overload the power transformers and blow power line fuses. This will be especially advantageous when power failures occur during the night when the pumper is not readily available to stagger pumping unit start-ups.

A downstream pressure sensing system may be used with the production monitoring and control system. This will be particularly useful where flowlines are exposed to freezing temperatures and where excessive parafin build up is encountered. The over-pressured flowline monitor can energize its own external warning light whenever the flowline pressure exceeds a predetermined maximum pressure, for example 250 PSI, thus giving the pumper an indication that the flowline is becoming plugged. If no remedial action is taken after the warning light is energized, the flowline monitor will shut the pumping unit down automatically when flowline pressure reaches some value above the preset maximum, for example 300 PSI. This could be a permanent shut down requiring that remedial work be done and the system be restarted manually.

The monitor and control circuitry has been designed so that line drivers can be installed to any of the monitoring functions for signal transmission to remote and computerized central locations.

Referring now to FIG. 8, another embodiment of the system is disclosed for use on a different type of oil well pumping installation. In this installation, an hydraulically actuated downhole pump 126 is sealingly located in a pump housing 127 attached to the lower end of a production tubing string 128. Elastomeric seals 129 provide sealing between housing 127 and the wellbore casing or wall 130.

The well head 10 has a production flowpipe 12 leading therefrom to surface storage facilities (not shown).

A flow sensor 19 may be located in flowpipe 12 to monitor flow therethrough. An electrical conduit 20 leads from sensor 19 to the controller panel 21 as previously described.

Hydraulic actuation fluid is pumped down tubing 128 by pump 131 which may be mechanically driven by a prime mover 136. A fluid reservoir 132 provides hydraulic fluid via pipe 133 to pressurizer 131 which pressurizes the fluid and pumps it through high pressure conduit 134 to well head 10 where it enters the tubing string 128.

A control lead 135 goes from panel 21 to a diverter valve 135a to communicate a divert signal from the controller panel to the valve 135*a*. A diverted fluid flowpipe 135*b* leads from valve 135*a* into the production flowpipe 12, downstream of sensor 19.

The well is pumped by providing high pressure hydraulic fluid down tubing 128 to the hydraulic pump 126. The pump 126 may be a single-acting hydraulic pump known in the art, or may be a double-acting pump of the type disclosed in U.S. Patent Application Ser. No.: 494,104, filed Aug. 2, 1974, by Donald E. Carrens and entitled "DOUBLE ACTING DOWNHOLE HYDRAULIC PUMP". The Carrens pump is a double-acting pump which pumps production fluid both on the upstroke and the downstroke.

Pumped fluid is discharged from the pump into the annulus above seals 129. The fluid column in the annulus above the seals is pushed upward and out flowpipe 12. The flow sensor 19 determines when production fluid is being pumped out of the well and sends the signal to the controller panel as previously described with respect to FIGS. 1 and 2.

Sensor 19 may be the valve type as shown in FIG. 2 or may consist of a flow orifice having pressure taps upstream and downstream of the orifice leading to a pressure switch to measure the differential pressure across the orifice and generate a signal when the pressure differential indicates fluid flow. Such sensors are disclosed in my copending U.S. Patent Application, Ser. No.: 452,851, filed Mar. 20, 1974, entitled "OIL WELL PUMPOFF CONTROL SYSTEM UTILIZING INTEGRATION TIMER", which application is herein incorporated by reference. Due to the relatively continuous pumping action of the double acting pump, the sensing system associated with the sensor 19 is primarily limited to use with the single-acting hydraulic pump unless some additional means such as a clock and relay are used with sensor 19 to provide a periodic signal therefrom.

The signal generated by sensor 19 is utilized in the controller panel, as previously described with respect to FIGS. 1 through 7, to determine the percentage of time during a given period that fluid is being pumped from the well and to regulate the well pump accordingly. When the production flow drops below the preselected minimum percentage, the diverter 135*a* is activated by way of lead 135 to divert a major portion of the pressurized activating fluid away from the downhole pump until the predetermined or precalculated downtime period has run and then the diverter is reactivated to begin pumping. A diverter is used to slow the pump down rather than shutting off the prime-mover since downhole hydraulic pumps are prone to sticking when completely stopped. The fluid pumping rate is then monitored again at some point in time after the pump has been returned to normal operation to determine if the recycle is successful or if the pump needs to be slowed down for an additional period of time. Again, as before, after a successful recycle the permanent shutdown counter 45 is reset to zero; or after a given number of consecutive unsuccessful recycles, the pumping system will be diverted permanently requiring a manual reactivation.

Due to the extremely high efficiency and capability of the hydraulic pump over the mechanically actuated pumps, this type of pumping installation is finding more and more usage in the oil fields. This is especially true in areas where large amounts of water are produced with the oil and where water-flood introduces large volumes of water into the production fluid.

Whereas the best of mechanical pumps may be capable of pumping up to 1000 barrels of fluid per day, the same size hydraulic pump can pump up to 2000 barrels per day from the same well. Thus, the present invention is particularly suitable on an hydraulically pumped well because the chances are greater that because of its higher capacity, the hydraulic pump will pump-off, whereas the mechanically pumped well might not. Therefore, even greater efficiency in production may be realized with this pump-off control system on an hydraulically pumped well because of the higher efficiency of the hydraulic pump and the reduction in unnecessary pumping achieved through this invention.

FIG. 9 illustrates in schematic diagram a pumping control installation in a well 10 having a pumped fluid flowpipe 12 leading therefrom, a production tubing string 137 inside the well casing 138, and an electric submersible well pump 139 inside the tubing string below the surface of the fluid 140 in the well. An electric power supply conduit 141 extends the length of the well and a power lead 142 runs inside the conduit from the submersible pump to the controller panel 21. Electrical power is supplied to the controller panel 21 for lead 142 by means of an electrical power generator 144 connected to panel 21 by electrical lead 143.

During the pumping operation, electrical power from generator 144 passes through lead 143, panel 21, lead 142 and into the electric pump 139. The pump draws in fluid from the well fluid 140 and pumps it up the tubing 137 to the surface.

A small tube 145 is located in the well alongside the tubing 137 and has therein a sensor for detecting whether the liquid level in the well is above or below the tube lower end. The sensor may be any of the known mechanisms in the art for determining fluid level such as a differential pressure activated switch, a capacitance measuring switch, or wave-speed measuring system such as radar or an acoustic sounder. The tube 145 is connected by conduit 146 at the earth's surface to a switch 147 which generates an electrical signal at its output in response to the sensor within tube 145 sensing that the fluid level is below the end of tube 145. The electrical output of switch 147 is connected into the input of an inverter 148 whose output is connected into one input of an AND gate 149. The other input to the AND gate 149 is connected to the output of a clock 150 which generates electrical pulses on a regular periodic basis, which period may be chosen by the well operator. The output of the AND gate 149 is connected to a coil 151 of relay 152. The other side of coil 151 is grounded and the wiper arm of relay 152 is also grounded. The normally open contact 153 of relay 152 is connected to oscillator 154 in a manner similar to the other embodiment illustrated herein, for example as illustrated and described with respect to oscillator 50 of FIG. 4.

In the operation of the apparatus and circuitry which is schematically illustrated with respect to FIG. 9, during the normal pumping sequence the sensor, located in tube 145, is located beneath the level of fluid 140 in the well and no signal is generated by switch 147. Thus, a logic 0 is applied to the input of the inverter 148 and a logic 1 is applied to the input of the AND gate 149 as is the output of the clock 150. Thus, as the pump operates, a signal is produced at the output of the AND gate 149 as long as the fluid level in the well is above a predetermined level. This causes the relay 152 to be activated which causes the ground to be applied to oscillator 154 and the circuit thereafter operates in a manner as described with respect to FIG. 4. This circuit serves to determine whether the fluid within the well bore is at or above a predetermined level longer than a given percentage of time during a given time interval.

FIG. 10 illustrates an alternate sensing means for determining when fluid is being pumped from the well. This system is operable with either of the pumping installations of FIGS. 8 and 9. In this embodiment, the electrical load current on the pump motor is monitored periodically to provide an indication of the well pumping operation. The illustrated circuitry of FIG. 10 is provided in the controller panel to monitor the load current of the pump motor. In the apparatus of FIG. 8, the circuitry is located in controller panel 21 to monitor the load drawn when an electric motor is used as the prime-mover 136.

When an electric submersible pump is used as illustrated in FIG. 9, the circuitry in controller panel 21 monitors the load current supplied to the electric pump 139 by way of leads 143 and 142.

In FIG. 10, the electric motor being monitored for current load is illustrated schematically at 155 and has power supplied thereto by an electric power source connected to input terminals 156, 157, and 158. The power source may supply three-phase AC power, and the primary 159 of a transformer 160 is connected in series with the phase which is connected to the terminal 158. The secondary coil 161 of transformer 160 is connected to a difference amplifier 162 through a relay 163. The input from secondary coil 161 is connected to the wiper arm 164 of relay 163 and the normally open contact 165 is connected to amplifier 162. A clock 166 produces a periodic output signal to coil 167, the opposite side of which is grounded.

Clock 166 is arranged to provide a periodic signal to coil 167 and the time period between the signals may be set by adjustment of the clock during manufacture or on location at the well site.

A second transformer 168 supplies a reference voltage from input terminals 169 and 170 to an additional input on the difference amplifier 162. It should be appreciated that the difference amplifier 162 is conventional and is preferably arranged to supply an output voltage only at such times as the voltage applied to transformer 160 exceeds the voltage applied through transformer 168 to the difference amplifier.

As is well known in the art, the electric motor 155 driving the pump will draw more current when fluid is being lifted than when pumping dry. The reference voltage from transformer 168 is chosen to be between the voltage signaled by transformer 160 when the pump is pumping dry and that signaled by transformer 160 when the pump is pumping a load of fluid.

Thus, at each periodic signal of clock 166, relay 163 signals a voltage proportional to the load current on motor 155 and, if the pump is pumping fluid, the difference amplifier 162 produces an output signal which is applied to coil 170 of relay 171. The wiper arm 172 of relay 171 is grounded, and the normally open contact 173 is connected to the oscillator 174. The output of oscillator 174 is connected into a counter similar to that of counter 52 of FIG. 4, and the operation thereafter is similar to that of the apparatus of FIG. 4, with comparisions being made with another oscillator (variable frequency) and its associated counter to determine whether the system is operating in a normal fashion for a predetermined percentage of time during a given time period. If the system is not operating for the predetermined percentage of time in a normal fashion, then the system proceeds to shut down and be recycled as previously discussed with respect to FIGS. 4 and 6.

This system is of a particular advantage where the hydraulic pump or electical submersible pump is operating in a well with varying conditions. For instance, in a well that flows alternating slugs of fluid and pockets of gas, a conventional well control system would tend to shut down the well for a predetermined, clocked period of time every time a bubble of gas passed through the pump. The prior systems also are subject to false readings and commands when a large sudden influx of gas in the well temporarily lifts the level of fluid in the well to an artificial level.

This system overcomes those deficiencies by determining the percentage of time over a given time period that fluid is being pumped from the well and shuts down the pumping operation only when that percentage drops below a certain preset desirable minimum amount.

Although specific preferred embodiments of the present invention have been described in the detailed description above, the description is not intended to limit the invention to the particular forms of embodiments disclosed therein since they are to be recognized as illustrative rather than restrictive and it will be obvious to those skilled in the art that the invention is not so limited. For instance, whereas the embodiment of FIG. 8 is described in conjunction with an hydraulic pumping installation using flow sensing means in the flowpipe, it is clear that the sensing systems, such as illustrated in the embodiments of FIGS. 9 and 10, could be used with the hydraulic pump of FIGS. 8 in place of the sensor therewith described. Likewise, the submersible electric pumping installation of FIG. 9 could be monitored with a system using the flowpipe sensor described with respect to FIG. 8 rather than the borehole fluid level sensor or the pump current load monitor. Also, while the preferred embodiment contemplates the use of various electrical, mechanical and electro-mechanical timing mechanisms, as well as the use of solid state devices such as the scaler circuit 45, those skilled in the art will recognize that equivalent devices can be used to provide the results of the invention. For example, the entire circuitry of FIGS. 4 and 6 can be fabricated from solid state components to provide greater space saving and cost reduction, as well as vastly improved reliability. Furthermore, although the preferred embodiment of the invention contemplates the use of electrical signals in determining the percentage of time in which the oil is flowing through the flow pipe, those skilled in the art will recognize that pneumatic signals can also be used in making such a determination. Likewise, although not illustrated, a ramp voltage device can be used and its amplitude compared at a given time with a known amplitude to provide a determination of the percentage of time during which the oil is being pumped. Thus, the invention is declared to cover all changes and modifications of the specific example of the invention herein disclosed for purposes of illustration which do not constitute departures from the spirit and scope of the invention.

As a further example, these embodiments of well pumping control systems are just as suitable for use on water wells, salt water wells, and any other type of fluid or gaseous wells operated by mechanical, hydraulic, or electric pumping means, in addition to oil wells as described hereinabove.

The embodiments of the invention in which an exclusive property or privilege is claimed are defined as follows:

1. A system for controlling the operation of a well pumping installation including an hydraulically actuated downhole pump, a fluid pressurizer communicating with said pump, a motor for operating said pressurizer, and a well fluid flowpipe; said system comprising:

flow detection means located in the well flowpipe and arranged to be responsive to fluid flow therethrough;

signal means connected to said flow detection means and arranged to generate signals indicative of said response;

means for receiving said signals and determining if the percentage of time during a given time interval that such signals are occurring is below a predetermined value; and, means for terminating the pumping operation when the percentage of time said signals are occurring is less than the predetermined value.

2. The system of claim 1 further comprising:

means for restarting said pumping operation after a predetermined period of shutdown time in said system;

recycle means in said system for resetting said determining means and said terminating means to allow recycling of the pumping operation;

shutdown means for preventing recycling of the operation after such operation has been recycled a predetermined number of times; and, resetting means for preventing the operation of said shutdown means when a successful recycle has occurred prior to recycling said predetermined number of times.

3. The system of claim 2 wherein said terminating means comprises means for diverting a major portion of the pressurized fluid away from the hydraulic pump.

4. The system of claim 2 wherein said terminating means comprises means for cutting off the pressurizer motor.

5. The system of claim 2 further comprising:

means for generating a pumping signal indicative of the duration of pumping time during a given cycle; and, means functionally related to said pumping signal for automatically adjusting the pump shutdown time during a subsequent pumping cycle.

6. A system for controlling the operation of a well pumping installation including an hydraulically actuated downhole pump, a fluid pressurizer connected to said pump, a motor actuating said pressurizer, and a pumped fluid flowpipe; said system comprising:

means for determining the availability of pumpable fluid in the well bore;

means for generating signals indicative of said determination;

means for determining whether said signals are occurring less than a predetermined percentage of time during a given time interval; and, means for terminating the pumping operation in the event of said lesser determination.

7. The system of claim 6 further comprising:

means for recycling the operation after a predetermined time following the termination of the operation;

means for preventing recycling of the operation after such operation has recycled a predetermined number of times; and, resetting means responsive to said determining means and arranged to override said preventing means when a recycle occurs wherein said signals occur at or above said predetermined percentage of time.

8. The system of claim 7 wherein said means for determining the availability of pumpable fluid in the well bore comprises wave generating means in the well bore adapted to send an energy wave down the well bore to reflect back from the well fluid surface; and, measuring means for receiving said reflected wave and determining the well fluid level from information related to said wave reception.

9. The system of claim 7 wherein said means for determining the availability of pumpable fluid in the well bore comprises sensing means suspended in the well bore at a predetermined pumpable level, said sensing means adapted to generate a signal in response to a fluid level at or above said pumpable level.

10. The system of claim 7 wherein the pressurizer motor is electrically powered and said means for determining the availability of pumpable fluid in the well bore comprises circuitry for monitoring the load current of the pressurizer motor and for comparing the level of said load current with a predetermined reference level.

11. A well production control system for controlling the operation of an electric submersible well pump; said control system comprising:

means for determining the availability of pumpable fluid in the well bore;

means responsive to said determining means for shutting down said electric submersible well pump when the availability of fluid drops below a predetermined level;

means for recycling said control system after said shutdown period;

means for shutting down said control system after a predetermined number of recycles; and, means for resetting said system and overriding said shutdown means if the availability of fluid rises above said predetermined level before said predetermined number of recycles.

12. The control system of claim 11 wherein said determining means comprises a fluid flow sensor in the flowpipe of the oil well, said sensor adapted to generate signals in response to the flow of fluid therethrough, said sensor arranged to communicate said signals to said shutdown means; and, said shutdown means comprising means for shutting off electric power to the electric submersible pump.

13. The control system of claim 11 wherein said determining means comprises wave generating means in the well bore adapted to send an energy wave down the well bore to reflect back from the well fluid surface; and measuring means for receiving said reflected wave and determining the well fluid level from information related to said wave reception; said shutdown means comprising means for shutting off electric power to the electric submersible pump.

14. The control system of claim 11 wherein said determining means comprises sensing means suspended in the well bore at a predetermined pumpable level, said sensing means adapted to generate a signal in response to a fluid level at or above said predetermined pumpable level; and said shutdown means comprising electric power cutoff means for shutting off electric power to the electric submersible pump.

15. The control system of claim 11 wherein said determining means comprises circuitry for monitoring the load current of the electric submersible pump and comparing the level of said load current with a predetermined reference level.

* * * * *

UNITED STATES PATENT OFFICE

CERTIFICATE OF CORRECTION

Patent No. 3,936,231 Dated February 3, 1976

Inventor(s) Bobby L. Douglas

It is certified that error appears in the above-identified patent and that said Letters Patent are hereby corrected as shown below:

Column 21, line 24 after "well" insert -- fluid --.

Signed and Sealed this

*twentieth* Day of *April 1976*

[SEAL]

*Attest:*

RUTH C. MASON
*Attesting Officer*

C. MARSHALL DANN
*Commissioner of Patents and Trademarks*